United States Patent [19]

Nakajima et al.

[11] 3,974,651

[45] Aug. 17, 1976

[54] AFTERBURNING CONTROL OF INTERNAL COMBUSTION ENGINE EXHAUST GAS

[75] Inventors: Yasuo Nakajima, Yokosuka; Yoshimasa Hayashi, Yokohama; Shin-Ichi Nagumo, Yokosuka, all of Japan

[73] Assignee: Nissan Motor Co., Ltd., Yokohama, Japan

[22] Filed: May 15, 1974

[21] Appl. No.: 470,313

[30] Foreign Application Priority Data

May 19, 1973 Japan ..... 48-55889

[52] U.S. Cl. ..... 60/290

[51] Int. Cl.[2] ..... F02B 75/10

[58] Field of Search ..... 60/289, 290, 274

[56] References Cited

UNITED STATES PATENTS

| | | | |
|---|---|---|---|
| 3,648,455 | 3/1972 | Muroki | 60/290 |
| 3,774,583 | 11/1973 | King | 123/119 A |
| 3,785,152 | 1/1974 | Pozniak | 60/290 |
| 3,812,673 | 5/1974 | Muroki | 60/290 |
| 3,818,880 | 6/1974 | Dawson | 123/119 A |
| 3,826,089 | 7/1974 | Nakajima | 60/290 |

*Primary Examiner*—Douglas Hart

[57] ABSTRACT

Flow of secondary air into the exhaust system is regulated by diaphragm assembly controlled valves between an air supply and the exhaust system. The diaphragm assemblies respond to vacuum in the intake air system of the engine.

3 Claims, 2 Drawing Figures

AFTERBURNING CONTROL OF INTERNAL COMBUSTION ENGINE EXHAUST GAS

Figure 1:
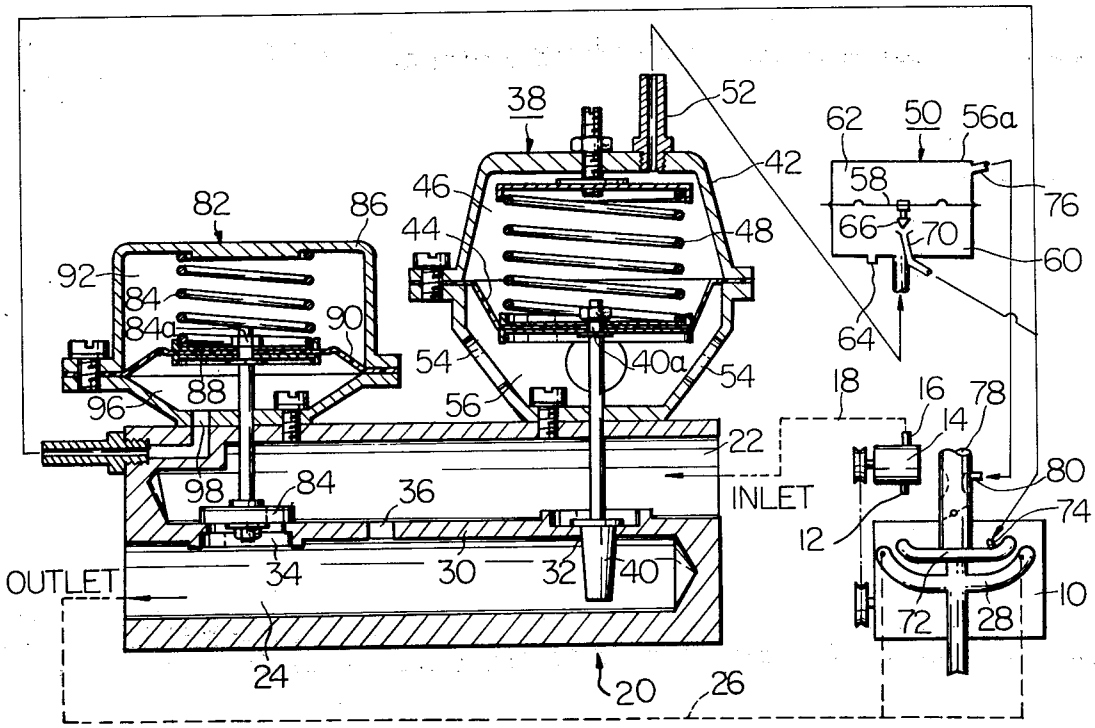

The present invention relates in general to a method of and an apparatus for controlling air flow to an internal combustion engine, and particularly to a control system for secondary air flow to the exhaust system of an internal combustion engine. More particularly, this invention is concerned with a method of and an apparatus for controlling air flow to the exhaust system of an internal combustion engine for automotive application which includes an exhaust system specifically designed for receiving secondary air for the purpose of reducing noxious exhaust compounds such as CO and HC by oxidation of such residual combustible compounds remaining in the exhaust gas of the internal combustion engine.

In accordance with the current common international policy for environmental pollution controls, it has been an imperatively pressing task for the manufacturers of automobiles to reduce or minimize the generation of noxious compounds included in the exhaust gas from internal combustion engines, such as HC and CO. In order to meet such requirements for clean exhausts from the internal combustion engines, there have been several practical approaches as typically seen today in the design modifications of the combustion chambers of the engine, etc.

As one of such approaches for producing clean exhausts from internal combustion engines, in a typical conventional design of an internal combustion engine including an afterburner wherein such noxious compounds which remain uncombusted in the exhaust gas from such engines are subjected to afterburning for the purpose of reducing such compounds and producing a relatively clean exhaust, it is well known that such afterburning is effected by supplying a secondary charge of air into an exhaust passageway of the engine, an exhaust port or an exhaust manifold thereof, by using an air supply pump which is constantly driven by the engine.

For an internal combustion engine for automotive application, it is essential to perform through a much wider range of loads and speeds than most prime movers do, and so an automobile engine should respond to such changes of load without loss of time. From the viewpoint of afterburning exhaust compounds such as CO and HC which remain not completely combusted in the exhaust from combustion engines are likely to be emitted into the atmosphere as such.

If afterburning is applied with the conventional arrangement of uncontrolled secondary air supply into the exhaust system of the engine without any relation to variations in the intake air volume to the engine, in an instance of engine braking the exhaust gas within the exhaust passageway would be excessively cooled due to excessive supply of such secondary air which would in turn lead to the desired afterburning not taking place, which is a significant drawback of an afterburning system of a conventional arrangement.

In consideration of the above described drawbacks in the exhaust afterburning of a conventional arrangement of an internal combustion engine, it would be advantageous to provide an improved apparatus for controlling a secondary supply of air to the engine in such a manner that while a maximum volume of air for use as a secondary supply for afterburning of exhaust compounds is constantly produced by the revolving engine shaft on one hand, a proper total volume of air supplied to the exhaust passageway of the engine is appropriately controlled. This invention is essentially intended to meet such requirements as described hereinbefore.

It is therefore a primary object of the present invention to provide an improved method and apparatus for controlling the volume of secondary air into the engine exhaust system in response to variations of venturi vacuum at the carburetor of an internal combustion engine, while assuring a maximum secondary air supply by an air supply pump for the purpose of improving the afterburning of combustible exhaust compounds in the exhaust system.

It is another object of this invention to provide an improved method and apparatus for supplying a volume of air to an internal combustion engine exhaust which corresponds to the concentration of combustible exhaust compounds from the engine for the purpose of improving the afterburning thereof.

It is still another object of this invention to provide an improved method and apparatus for supplying air into the exhaust system of an internal combustion engine for a short period in response to acceleration of the engine, whereby good afterburning takes place of increased uncombusted compounds therein in such an engine operating condition.

The foregoing objects, as well as further objects and advantages thereof, will become more apparent from the following detailed description with respect to a preferred embodiment of the invention when read in conjunction with the accompanying drawings.

Figure 2:
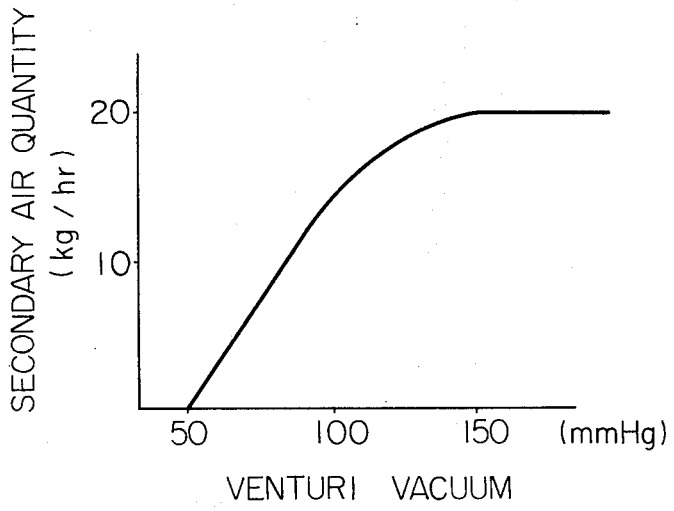

In the accompanying drawings:

FIG. 1 is a schematic view showing a preferred embodiment of an apparatus for controlling secondary air flow into the exhaust system of an internal combustion engine according to the present invention; and FIG. 2 is a graphic representation showing a characteristic curve with respect to the secondary air supply versus vacuum generated by the apparatus according to this invention.

FIG. 1 shows an internal combustion engine 10, including a secondary air supply pump 14 with a relief valve 12 incorporated, and an exhaust manifold 28. The pump 14 is constantly driven by the engine 10, and a secondary air supply apparatus 20 including an air inlet port 22 which communicates with an air outlet port 16 of the secondary air supply pump 14 through an air supply line 18 for receiving air therefrom. An air outlet port 24 of the secondary air supply apparatus 20 communicates with the exhaust manifold 28 of the engine through an air supply line 26.

A partition wall 30 between the inlet port 22 and outlet port 24 is provided with a first valve and a second valve (no numerals) and an orifice 36 which all control communication between the inlet and outlet ports 22 and 24, respectively. The first valve has a valve head 40, seat 32 and a stem **40*a* connected to a first valve control mechanism 38 above the inlet port 22. The mechanism 38 is a diaphragm assembly 42 having a diaphragm 44 dividing the assembly into a vacuum chamber 46 and an air chamber 56 which communicates with the atmosphere through holes 54. The valve stem 40*a* is fixed to the diaphragm 44 which is urged to close the first valve by a spring 48 disposed in the vacuum chamber 46. A booster diaphragm assembly 50 is connected to the vacuum chamber 46 through a fitting 52**.

The booster diaphragm assembly 50 comprises a booster diaphragm 58 disposed in a generally central position of a casing 56*a* of the diaphragm assembly 50 dividing the assembly 50 into a booster chamber 60 located in the direction of the abovementioned fitting 52 of the control mechanism 38 and a vacuum chamber 62. The booster chamber 60 is provided with an orifice 64 to vent to the atmosphere and a tube 70 for introducing vacuum to operate a valve 66 connected to the center of the diaphragm 58. This vacuum tube 70 is connected to a vacuum tap 74 provided in the intake manifold 72 of the engine so that vacuum may be sensed during the engine operations. Further, in the vacuum chamber 62 of the booster diaphragm mechanism 50, there is provided another tap 76 for introducing vacuum which further communicates with a vacuum generating point 80 located at the venturi 78.

The second valve has a valve head 84, a seat 34 and a stem 84*a* connected to an acceleration responsive mechanism 82 disposed above the outlet port 24. The mechanism 82 is also a diaphragm assembly 86 having a diaphragm 90 dividing the assembly 86 into a vacuum chamber 96 and an upper chamber 92 above the vacuum chamber 96. The stem 84*a* is fixed to the diaphragm 90 which is biased downward in FIG. 1 by a spring 94 disposed in the upper chamber 92. The vacuum chamber 96 communicates through a port 98 with the vacuum tap 74, and communicates also with the upper chamber 92 through an orifice 88 in the diaphragm 90.

After starting the engine 10, the secondary air pump 14 is driven by the engine. By the operation of this secondary air pump 14, air is supplied to the air inlet port 22 of the secondary air control apparatus 20. This is a maximum volume of air deliverable from the pump 14 at any given speed of the engine. With this secondary air supply, in the event that the throttle opening of the engine is increased and therefore, a high vacuum is produced at the venturi 78, the diaphragm 58 of the booster diaphragm mechanism 50 moves toward the vacuum chamber 62 in response to increased vacuum at the venturi 78. Consequently, vacuum within the booster chamber 60 is higher than vacuum within the vacuum chamber 62 which is atmospheric pressure minus the vacuum at the venturi 78, and thus higher vacuum within the booster chamber 60 will in turn cause the diaphragm 44 in the control mechanism 38 to be displaced upwardly toward the vacuum chamber 46 against the biasing force of the spring 48 until an equilibrium is reached. By this upward displacement of the diaphragm 44, the valve head 40 is caused to unseat the first valve seat 32. Thus secondary air from the air pump 14 flows into the exhaust manifold 28 of the engine in an amount that is proportional to the extent of opening of the first valve, i.e., the degree of vacuum prevailing in the vacuum chamber 46, thus causing afterburning of exhaust compounds which remain uncombusted in the exhaust gas from the engine 10.

In the event that the engine throttle valve is closed and vacuum generated at the venturi 78 is reduced, such as in engine braking operation, the diaphragm 44 in the control mechanism 38 is caused to be displaced downwardly as viewed in FIG. 1 by the biasing force of the spring 48, the opening between the first valve head 40 and seat 32 is reduced in response to the vacuum working on the effective area of diaphragm 44, and consequently, the supply of secondary air from the air pump 14 to the exhaust manifold 28 of the engine will be more than required for afterburning of the residual combustible exhaust compounds within the exhaust system of the engine. The relief valve 12 incorporated in the air pump 14 is appropriately adjusted to relieve the air pressure produced therewithin when there is no or very little air required therefrom, the excessive volume of secondary air will then be released to the atmosphere through the relief valve 12. At the same moment, vacuum forming in the intake manifold 72 of the engine will increase on one hand, therefore, according to the extent of higher vacuum, on the other hand the lower chamber 96 of the acceleration responsive valve mechanism 82 is under vacuum. Due to this vacuum within the lower chamber, the level of vacuum within the upper chamber 92 will increase to be equivalent to that of the lower chamber 96 through the orifice 88 provided in the diaphragm 90, thus an equilibrium in vacuum within the upper and lower chambers of the acceleration responsive mechanism 82 is reached.

In contrast, when the engine is accelerated or the engine throttle valve is fully opened, the vacuum generated within the engine exhaust manifold 72 is reduced by the atmospheric pressure, and therefore, vacuum within the lower chamber 96 of the acceleration responsive mechanism 82 will also be reduced. In such a reduced state of vacuum within the lower chamber 96 while there remains a high vacuum within the upper chamber 92, a pressure difference therebetween exists initially which in turn results in a displacement of the diaphragm 90 upwardly toward the upper chamber 92 against the biasing force of the spring 94. With this upward displacement of the diaphragm 90, the valve head 84 is caused to be unseated from the second valve seat 34, through which valve secondary air from the air pump 14 again starts to be supplied to the engine exhaust manifold 28.

At the moment when the acceleration of the engine levels off, the unbalanced vacuum state existing within the upper and lower chambers 92 and 96 of the abovementioned acceleration responsive mechanism 82 is then balanced by the orifice 88 letting air pass therethrough until a pressure balance is obtained between the two chambers. By this equilibrium of pressures between the two chambers, the abovementioned diaphragm 90 is then displaced downwardly as viewed in FIG. 1 toward the lower chamber 96 by the biasing force of the spring member 94, thus closing the second valve.

In this state of vacuum levels and valve functions, when the throttle valve of the engine is opened, the control mechanism 38 operates in the same sequence as described hereinbefore. When the engine is idling no secondary air from the air pump 14 to the exhaust manifold 28 would flow because the first valve 40 and the second valve 84 are closed, were it not for the idling hole 36 provided in the partition 30 for the purpose of admitting a small quantity of air into the exhaust manifold 28 of the engine, for continuing afterburning the exhaust compounds under such a restricted idling condition.

FIG. 2 is a graphic representation of the relationship of secondary air flow or quantity to vacuum in the intake air system. When the venturi vacuum is increasing to a higher level in such a range of engine operation where the engine throttle valve is opened to a certain extent, for instance, in FIG. 2 between more than 50 mmHg and 120 mmHg, the secondary air quantity is increasing sharply, and at a certain predetermined point of vacuum, such as 140 mmHg shown in FIG. 2, the air volume ceases to increase and is maintained at a desired level, such as 20 kg/hr shown in FIG. 2. These figures represent exemplary data obtained during a series of experiments under certain circumstances, and they may of course be predetermined optionally.

As is obvious from the foregoing description, such components as the booster diaphragm mechanism 50 and the idling restrictor 36 may be of course omitted by an appropriately predetermined setting on the part of the control mechanism 38 to adjust the balance of the vacuums to the points where necessary, such as engine braking and idling operations of the engine, respectively.

As described in detail hereinbefore by way of a preferred embodiment, this invention may be reduced to practice in an internal combustion engine having an air pump for supply secondary air for the purpose of performing afterburning of exhaust residual combustible compounds. Although not shown in the accompanying drawing, alternatively, some more embodiments of this invention may be employed by way of applying a solenoid valve mechanism in the secondary air charge route of the engine which is adapted to work in cooperation with the throttle valve of the engine so that the variations in vacuum created in both the intake and exhaust manifolds of the engine may be detected to regulate secondary air flow thereto, according to the operating conditions of the engine.

By virtue of such arrangement according to a preferred embodiment of this invention, there is provided an improved afterburning system of residual combustible compounds in the exhaust from an internal combustion engine having such advantageous features as well as useful effects as summarized in the following: this system is capable of controlling a secondary air supply in response to variations of vacuum generated at the venturi of the engine carburetor, while assuring a maximum volume of secondary air by an air pump which is available at any moment when so required, so that an appropriate air quantity is available in an exhaust passageway of the engine, that an appropriate air volume is selected with respect to the concentration of the combustible exhaust compounds and that such secondary air is available for a short period in response to acceleration of the engine, whereby a good afterburning effect is achieved of the exhaust compounds at such operating condition of the engine.

What is claimed is:

1. An improvement in an internal combustion engine including a secondary air pump, an air intake system, a carburetor having a venturi and an exhaust passageway to receive secondary air, the improvement comprisng control means operatively connected between said pump and said exhaust passageway and operative to change the quantity of said secondary air to said exhaust passageway in response to vacuum variations in the air intake system of said engine, said control means comprising a first diaphragm assembly including a first diaphragm, a vacuum chamber communicating with said air intake system of said engine, and an atmospheric chamber opened to the atmosphere, a first valve mounted between said secondary air supply pump and said exhaust passageway, the first valve connected to said first diaphragm of said first diaphragm assembly to control the flow of said secondary air into said exhaust passageway in response to vacuum created at the venturi of the carburetor of said engine, and in parallel with said first diaphragm assembly a third diaphragm assembly including a second diaphragm, which comprises a vacuum chamber, and a chamber disposed in the opposite position to said vacuum chamber of said third diaphragm assembly and communicating with an intake manifold of said engine, and a second valve connected to said second diaphragm for the third diaphragm assembly to operatively control said second valve to open for said secondary air to enter said exhaust passageway of said engine in accordance with the extent of reduction of said vacuum in said intake manifold at a period of acceleration of said engine.

2. An improvement as claimed in claim 1, further comprising a booster diaphragm assembly operatively connected between said vacuum chamber of said first diaphragm assembly and said venturi to increase the effect of said vacuum created at said venturi to increase accurate operation of said first diaphragm assembly.

3. An improvement as claimed in claim 1, further comprising a restrictor in a partition between an air inlet and an air outlet disposed adjacent to and operatively connected with said first and third diaphragm assemblies and there between, to provide a metering orifice so as to provide during idling operation of said engine a metered air quantity to said exhaust passageway, when said first and second valves are closed.

* * * * *